US008178213B2

(12) United States Patent
Werger

(10) Patent No.: US 8,178,213 B2
(45) Date of Patent: May 15, 2012

(54) METHOD FOR APPLYING A COATING MATERIAL AND COATING FOR A METALLIC SURFACE

(75) Inventor: Heinrich Werger, Kuchl (AT)

(73) Assignee: Robert Bosch GmbH, Stuttgart-Feuerbach (DE)

( * ) Notice: Subject to any disclaimer, the term of this patent is extended or adjusted under 35 U.S.C. 154(b) by 0 days.

(21) Appl. No.: 12/309,651

(22) PCT Filed: Jun. 4, 2007

(86) PCT No.: PCT/AT2007/000269

§ 371 (c)(1),
(2), (4) Date: Jan. 26, 2009

(87) PCT Pub. No.: WO2008/011642

PCT Pub. Date: Jan. 31, 2008

(65) Prior Publication Data

US 2009/0252968 A1 Oct. 8, 2009

(30) Foreign Application Priority Data

Jul. 26, 2006 (AT) ..... A 1273/2006

(51) Int. Cl.
*B32B 19/00* (2006.01)

(52) U.S. Cl. ..... 428/610; 428/408; 428/539.5; 428/627; 428/628; 428/697

(58) Field of Classification Search ..... 428/216, 428/336, 408, 539.5, 610, 627, 628, 697, 428/698

See application file for complete search history.

(56) References Cited

U.S. PATENT DOCUMENTS

| | | | | |
|---|---|---|---|---|
| 6,033,533 | A * | 3/2000 | Sugiyama et al. | 204/192.12 |
| 6,228,471 | B1 * | 5/2001 | Neerinck et al. | 428/216 |
| 6,562,445 | B2 * | 5/2003 | Iwamura | 428/217 |
| 6,740,393 | B1 | 5/2004 | Massler et al. | |
| 7,228,786 | B2 * | 6/2007 | Hamada et al. | 92/155 |
| 7,537,822 | B2 * | 5/2009 | Ishikawa | 428/212 |
| 7,563,509 | B2 * | 7/2009 | Chen | 428/408 |
| 2004/0038033 | A1 | 2/2004 | Massler et al. | |
| 2004/0219294 | A1 | 11/2004 | Massler et al. | |
| 2006/0182895 | A1 | 8/2006 | Denui et al. | |

FOREIGN PATENT DOCUMENTS

| | | |
|---|---|---|
| DE | 199 20 567 | 11/2000 |
| DE | 102 12 299 | 10/2003 |
| DE | 10 2004 002 678 | 8/2005 |
| EP | 1 096 044 | 5/2001 |
| WO | 01/79585 | 10/2001 |
| WO | 2005/014882 | 2/2005 |
| WO | 2006/005288 | 1/2006 |

* cited by examiner

*Primary Examiner* — Cathy Lam
(74) *Attorney, Agent, or Firm* — Fitch, Even, Tabin & Flannery LLP

(57) ABSTRACT

In a method for applying a multilayer wear-resistant coating on metallic, optionally already coated, surfaces, the coating is composed of at least two anti-wear layers (5) and an intermediate layer (10) each arranged between two anti-wear layers (5). The intermediate layer (10) is comprised of a material composition containing the material of the anti-wear layer (5) and a further material, wherein the application of the intermediate layer (10) is effected with a content of the material of the anti-wear layer (5) decreasing over a first transition region (a) and a content of the material of the anti-wear layer (5) increasing over a second transition region (b), the content of the material of the anti-wear layer (5) in the intermediate layer (10) being selected to be at least 5% by weight in every point.

24 Claims, 1 Drawing Sheet

METHOD FOR APPLYING A COATING MATERIAL AND COATING FOR A METALLIC SURFACE

CROSS-REFERENCE TO RELATED APPLICATIONS

Figure 1:
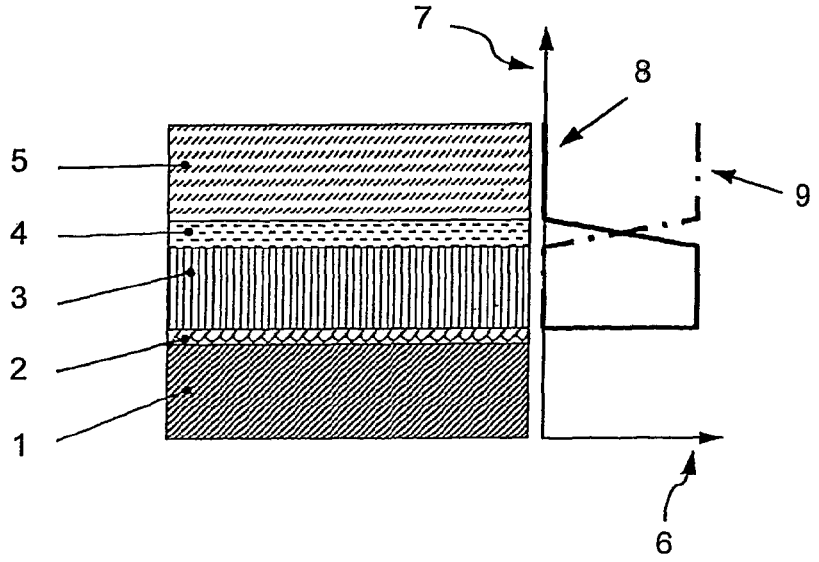

This is a U.S. National Phase of International Application PCT/AT2007/000269, filed Jun. 4, 2007 and claims the benefit of foreign priority under 35 U.S.C. §119 from Austrian Patent Applications A 1273/2006, filed Jul. 26, 2006, the entire disclosures of which are hereby incorporated by reference herein.

BACKGROUND OF THE INVENTION

The invention relates to a method for applying a multilayer wear-resistant coating on metallic, optionally already coated, surfaces, wherein the coating is composed of at least two anti-wear layers and an intermediate layer each arranged between two anti-wear layers, as well as a coating for a metallic surface.

With heavily loaded component parts as they are, for instance, encountered in the servo-valve or nozzle of an injector in a common-rail injection system, it has been common in the prior art to realize a coating by using especially hard materials in order to increase both hardness and wear-resistance. A coating comprising several layers also belongs to the prior art.

In doing so, it is desirable, in order to achieve the required wear indices, to be able to apply layer thicknesses as large as possible, wherein, however, the use of especially hard materials as coating materials will limit the layer thickness on account of the residual stresses occurring within the layer and rising with the layer thickness. Residual stresses in the layer will, as a rule, lead to the formation of cracks in the coating and/or chipping off. In this context, a layer sequence has been proposed in WO 2006/005288 A1, in which an adhesive layer based on Cr is initially applied on a metallic surface, a CrN gradient layer is applied on the adhesive layer, and at least one covering layer having a constant composition based on CrN, $Cr_2N$ or a mixture of the two phases is applied on the CrN gradient layer. The CrN layer is characterized by relatively low residual stresses so as to enable the application of CrN layers in clearly larger layer thicknesses.

From DE 102004002678 B4, a multilayer coating for the valve needle of a valve is to be taken, wherein the layer sequence comprises at least a first adhesive layer, a first anti-wear layer, a second adhesive layer and a second anti-wear layer, said layer sequence being repeatedly applicable several times, if required. With such a configuration, a plurality of anti-wear layers of small layer-thicknesses can be assembled to an altogether sufficiently thick coating. The individual anti-wear layers can be applied in thicknesses, which ensure that no excessive residual stresses occur, eventually causing the anti-wear layers to chip off. The adhesive layers applied between the anti-wear layers in that case are made of materials markedly softer than the material of the anti-wear layer.

According to the prior art, it is thus provided that individual anti-wear layers made of highly wear-resistant, hard materials are combined with adjoining or interposed intermediate, transition or adhesive layers made of materials softer than the material of the anti-wear layer so as to increase the overall coating thickness, wherein the necessary elasticity to prevent the harder material from chipping off is provided by the softer material arranged therebetween. The increase in the overall coating thickness is, however, opposed by the local reduction of the wear resistance caused by the softer material of the intermediate layers. Under extreme loads, a removal of the uppermost applied anti-wear layer will unavoidably be caused, thus exposing the underlying intermediate layer made of a less wear-resistant material, which, in the following, will be relatively rapidly worn such that a layer structure of this type will, in the main, be prone to relatively rapid wear.

The present invention, therefore, aims to increase the wear resistance of a multilayer coating in which an intermediate layer is each arranged between individual anti-wear layers, and to provide a method for producing such a multilayer coating.

To solve this object, the invention is essentially characterized in that the intermediate layer is comprised of a material composition containing the material of the anti-wear layer and a further material, wherein the application of the intermediate layer is effected with a content of the material of the anti-wear layer decreasing over a first transition region and a content of the material of the anti-wear layer increasing over a second transition region, the content of the material of the anti-wear layer in the intermediate layer being selected to be at least 5% by weight at every point. In such a layer structure, transition regions in which the content of the material of the adjacent anti-wear layers increases or decreases, respectively, are formed in the respective intermediate layer, with a material different from the material of the anti-wear layer being admixed at a respectively increasing or decreasing content. The overall content of the further material in the intermediate layer is, however, limited such that, according to the invention, a minimum content of 5% by weight of the material of the anti-wear layer is contained in the intermediate layer at every point. It is thereby safeguarded that the wear properties will be maintained in the intermediate layer while, at the same time, kind of a relaxation zone will nevertheless be produced between two anti-wear layers to prevent chipping or cracking caused by residual stresses occurring in the material of these layers.

In order to achieve as continuous a transition as possible between the individual layers, it is preferably provided that the content of the material of the anti-wear layer in the intermediate layer is decreased or increased according to a ramp function. In order to further ensure that the intermediate layer will exhibit sufficient wear resistance even under high loads, it is preferably provided that the content of the material of the anti-wear layer in the intermediate layer is decreased to at least 30% by weight, preferably to at least 50% by weight. This will preferably result in a layer structure in which an anti-wear layer, i.e. a layer having a content of 100% by weight of coating material, is followed by a first transition region of the intermediate layer, in which the content of the material of the anti-wear layer is decreased from 100% by weight to, for instance, 50% by weight and the content of the further material is increased accordingly. For the transition to the next superimposed anti-wear layer of pure material, a further transition region of the intermediate layer is subsequently provided, in which the content of the material of the anti-wear layer is again increased to 100% by weight and the content of the further material is decreased accordingly. The first transition region preferably directly adjoins the anti-wear layer located therebelow, and the second transition region directly merges into the anti-wear layer arranged thereabove. Between the first transition region, in which the content of the material of the anti-wear layer is lowered, and the second transition region, in which the content of the material of the anti-wear layer is again raised, a further region in which the content of the materials is selected to remain unchanged may be arranged, if desired. A configuration in which the second transition region directly adjoins the first transition region is, however, preferred, because the intermediate layer is to be formed as thin as possible and no other functional subregions appear necessary besides the two transition regions serving the material transition.

In a preferred manner, the layers are applied by a CVD process, wherein processes are known from the prior art, in which the mass ratios of the individual materials can be continuously varied during the application of the layers.

In order to achieve a configuration as wear-resistant as possible, it is preferably provided that the anti-wear layer is comprised of a diamond-like carbon material (DLC). In addition to the material of the anti-wear layer, the intermediate layer preferably contains a further wear-resistant material such as, e.g. CrN.

In the following, the invention will be explained in more detail by way of an exemplary embodiment schematically illustrated in the drawing. Therein, FIG. 1 illustrates a multilayer coating according to the prior art, and FIG. 2 illustrates a coating according to the invention.

In the layer sequence according to FIG. 1, an adhesive layer 2 of a soft material, e.g. Cr, is at first applied on the material 1 to be coated. After this, a first anti-wear layer 3 which may, for instance, be comprised of CrN is applied. In a transition region 4, the concentration of the material of the first anti-wear layer is decreased to zero and, at the same time, the concentration of the material of a second anti-wear layer 5 made, for instance, of DLC (diamond-like carbon) is increased. Subsequently, a second anti-wear layer 5 is applied. The diagram depicts the concentration 6 as a function of the distance 7 from the surface of the component part 1 to be coated, the full line 8 indicating the concentration of the material of the first anti-wear layer and the dot-and-dash line 9 representing the concentration of the material of the second anti-wear layer.

Figure 2:
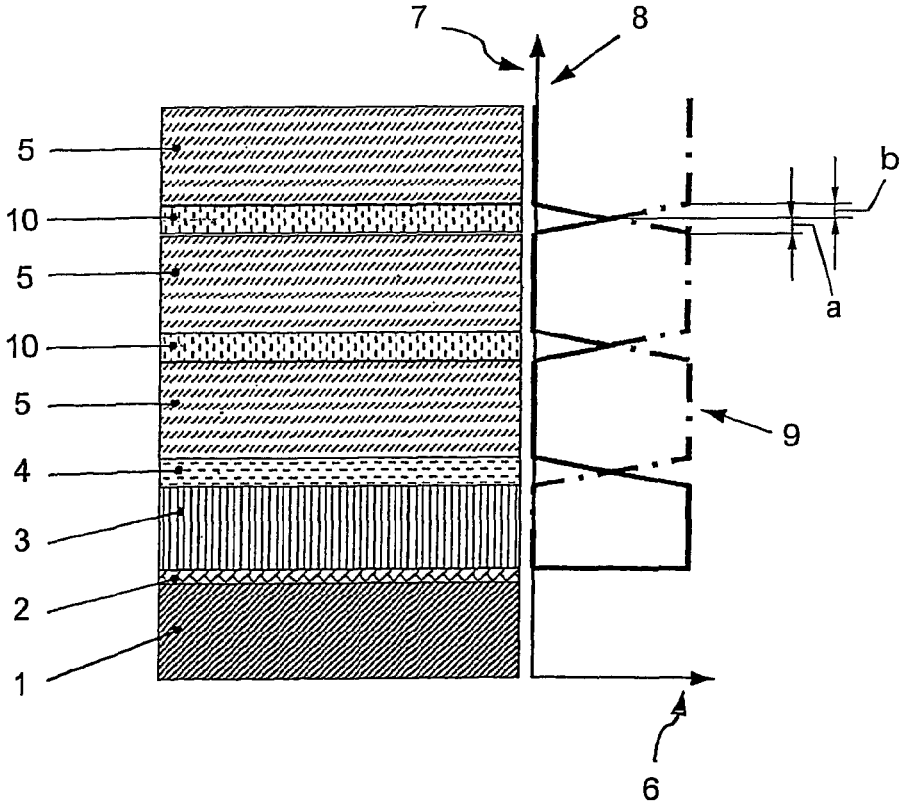

FIG. 2 illustrates a coating according to the present invention. Upon the already known layer sequence comprising the material 1 to be coated, the adhesive layer 2, a first anti-wear layer 3, a protective transition layer 4, and a second anti-wear layer 5 follows an intermediate layer 10 in which the concentration of the material of the adjacent anti-wear layers is decreased from 100% to 50% in a first transition region a and is again increased to 100% in a second transition region b, wherein a further material, i.e. the material of layer 3 in the present case, is admixed accordingly, with a content of the further material being raised up to 50% in the transition region a and again lowered to zero in the second transition region b following thereupon. This intermediate layer 10 is followed by a further ply of the second anti-wear layer 5. The application of the intermediate layer 10 and the second anti-wear layer 5 may subsequently be repeated several times.

The advantage of the present invention resides in that, due to the coating, the stresses occurring in the anti-wear layers 3 and 5 from a certain layer thickness will normally increase to such an extent that the coating will no longer safely adhere. The thickness of a coating is, thus, limited upwards. By introducing the special intermediate layer 10, stresses will be reduced, and a further ply of the same protective layer can be applied such that the realization of almost any coating thickness will be feasible in practice.

For the material of the anti-wear layer 5, DLC (diamond-like carbon) may be selected. For the material of the anti-wear layer 3, which is also admixed to the intermediate layer 10, CrN may, for instance, be selected. However, the material admixed to the intermediate layer 10 need not necessarily correspond with the material of the anti-wear layer 3.

It should further be noted that the layer structure formed by the repeated application of layers 5 and 10 need not necessarily be applied on the component part 1 via the interposition of layers 3, 4 and, optionally, 2. On the contrary, the direct application, with or without interposition of an adhesive layer, is also conceivable. The arrangement of layer 3, which is made of a softer material as compared to the material of the anti-wear layer 5, is merely effected to provide a continuous transition from the soft material of the component part 1 to the very hard material of the anti-wear layers 5.

The invention claimed is:

1. A method for applying a multilayer wear resistant coating on a metallic, optionally already coated, surface wherein the multilayer wear-resistant coating is composed of at least first and second anti-wear layers each consisting of a diamond-like carbon (DLC) material and an intermediate layer arranged between the first and second anti-wear layers, in which the first anti-wear layer is arranged on the metallic, optionally already coated, surface, said intermediate layer having a first transition region that extends away from said first anti-wear layer and contains (DLC) material, and a second transition region extending towards said second anti-wear layer which contains said DLC material, wherein said method includes applying the intermediate layer while adjusting its composition so that a concentration of said DLC material in the first transition region decreases as a function of an increasing distance from the metallic surface, and the concentration of said DLC material increases in the second transition region as a function of the increasing distance from the metallic surface, and said intermediate layer has at least 5 by weight of said DLC material at every point.

2. A method according to claim 1, wherein in the intermediate layer the concentration of said DLC material is decreased or increased according to a ramp function.

3. A method according to claim 1, wherein in the intermediate layer the concentration of said DLC material is at least 30% by weight.

4. A method according to claim 1, wherein said applying step is effected so that in said first transition region the concentration of said DLC material is decreasing from 100% by weight, and in said second transition region the concentration of said DLC material is increasing up to a content of 100% by weight.

5. A method according to claim 1, wherein the first transition region directly adjoins the first anti-wear layer, and the second transition region directly merges into the second anti-wear layer.

6. A method according to claim 1, wherein, in said intermediate layer, the first transition region directly adjoins the second transition region.

7. A method according to claim 1, wherein the layers are applied by a CVD process.

8. A method according to claim 1, wherein said intermediate layer includes an additional wear-resistant material, which is not said DLC material.

9. A method according to claim 1, wherein in the intermediate layer the concentration of said DLC material is at least 50% by weight.

10. A multi-layer coating for a metallic surface, which is composed of at least two anti-wear layers each consisting of a diamond-like carbon (DLC) material and an intermediate layer arranged between first and second anti-wear layers, wherein said first anti-wear layer is closer to the metallic surface, said intermediate layer is comprised of a material composition containing said DLC material, said intermediate layer having a first transition region extending away from the first anti-wear layer over which a content of said DLC material decreases as a function of an increasing distance from the metallic surface and a second transition region towards the second anti-wear layer over which the content of said DLC material increases as a function of the increasing distance from the metallic surface, wherein the intermediate layer has at least 5% by weight of said DLC material at every point.

11. A coating according to claim 10, wherein, in the intermediate layer, the content of said DLC material decreases or increases according to a ramp function.

12. A coating according to claim 10, wherein, in the intermediate layer, the content of said DLC material is at least 30% by weight.

13. A coating according to claim 10, wherein the first transition region of the intermediate layer is applied so that the content of said DLC material decreases from 100% by weight, and the second transition region is applied so that the content of said DLC material increases up to a content of 100% by weight.

14. A coating according to claim 11, wherein the first transition region directly adjoins the first anti-wear layer, and the second transition region directly merges into the second anti-wear layer.

15. A coating according to claim 11, wherein the second transition region directly adjoins the first transition region.

16. A coating according to claim 11, wherein said intermediate layer includes a further wear-resistant material that is not said DLC material.

17. A coating according to claim 16, wherein said intermediate layer includes CrN as the further wear-resistant material.

18. A coating according to claim 11, wherein said coating further comprises a further layer of another material on the metallic surface, wherein said coating comprises said further layer of another material, said first anti-wear layer over said further layer, said intermediate layer, and said second anti-wear layer over said intermediate layer.

19. A coating according to claim 18, wherein said coating further comprises a transition layer between said further layer and said first anti-wear layer with an increasing concentration of said DLC material as a function of distance from the metallic surface, and an accordingly decreasing content of the another material.

20. A coating according to claim 18, wherein said coating includes an adhesive layer, wherein the adhesive layer is interposed between the metallic surface and said further layer of said coating.

21. A coating according to claim 10, wherein, in the intermediate layer, the content of said DLC material is at least 50% by weight.

22. A method according to claim 21, wherein said method further comprises iteratively repeating steps (b) and (c).

23. A method according to claim 21, wherein in (a) said metallic surfaces has already been coated.

24. A method for producing a multi-layer wear resistant coating on a metallic, optionally already coated, surface, said multi-layer wear resistant coating comprising an anti-wear layer, an intermediate layer, and a further anti-wear layer, said method comprising (a) forming the anti-wear layer on said metallic, optionally already coated, surface;

(b) forming an intermediate layer over the anti-wear layer, said intermediate layer having a first transition region extending away from said anti-wear layer and a second transition region extending towards said further anti-wear layer, said intermediate layer comprising a material composition containing the material of the anti-wear layer and the further anti-wear layer whereby a content of the anti-wear material decreases and then increases over the intermediate layer as a function of a distance from the metallic surface, whereby there is a concentration gradient in which the material of the anti-wear layer decreases as the first transition region extends away from the anti-wear layer and the material of the further anti-wear layer increases as the second transition layer extends towards the further anti-wear layer; and (c) forming the further anti-wear layer over the intermediate layer, wherein the material of the anti-wear layer and of the further anti-wear layer is a diamond-like carbon (DLC) material.

* * * * *